US006358088B1

(12) United States Patent
Nishio et al.

(10) Patent No.: US 6,358,088 B1
(45) Date of Patent: Mar. 19, 2002

(54) MINIATURE CONNECTOR

(75) Inventors: Atsushi Nishio, Ibaraki; Katsuhiro Hori, Mito; Kazuhiro Okazaki, Hitachinaka; Fumihiro Hosoya, Ibaraki, all of (JP)

(73) Assignee: Mitsumi Electric Co., Ltd. (JP)

( * ) Notice: Subject to any disclaimer, the term of this patent is extended or adjusted under 35 U.S.C. 154(b) by 0 days.

(21) Appl. No.: 09/510,873

(22) Filed: Feb. 23, 2000

(30) Foreign Application Priority Data

Feb. 26, 1999 (JP) ..... 11-049247

(51) Int. Cl.[7] ..... H01R 13/40
(52) U.S. Cl. ..... 439/596; 439/595; 439/610
(58) Field of Search ..... 439/406, 608, 439/404, 405, 610, 596, 703, 589, 606, 31, 165, 595, 467, 546, 587

(56) References Cited

U.S. PATENT DOCUMENTS 4,493,525 A * 1/1985 Hall et al. ..... 439/143 R
4,497,531 A * 2/1985 Baker ..... 439/94 M
4,867,705 A * 9/1989 Yuasa ..... 439/595
5,147,222 A * 9/1992 Hotea et al. ..... 439/589
5,511,993 A * 4/1996 Yamada et al. ..... 439/610
5,906,503 A * 5/1999 Wiencek et al. ..... 439/418
6,024,606 A * 2/2000 Morikawa et al. ..... 439/610
6,056,569 A * 5/2000 Nakamura ..... 439/189
6,135,824 A * 10/2000 Okabe et al. ..... 439/701
6,176,740 B1 * 1/2001 Abe et al. ..... 439/596

* cited by examiner

*Primary Examiner*—Gary Paumen
*Assistant Examiner*—James R. Harve
(74) *Attorney, Agent, or Firm*—Morrison Law Firm

(57) ABSTRACT

A miniature connector has an inner insulated body, which supports a plurality of contact conductors which contact conductors on a companion connector, the inner insulating body being surrounded on the outside by a shield case, and an outer surface of a connection cord side end of the shield case is covered by an external insulated mold, adjacent contact conductor housing holes, in which connection ends of the contact conductors are placed, have differing depths, a connecting part cover, formed in unitary manner with the inner insulated body preventing a connection cord core wire, which is soldered onto each of the connection ends, from popping out of its corresponding contact conductor housing hole.

3 Claims, 3 Drawing Sheets

MINIATURE CONNECTOR

BACKGROUND OF THE INVENTION

The present invention relates to an electrical connector. In particular, the present invention relates to a miniature connector used in connecting electronic devices such as personal computers and the like.

Because of component crowding in small space areas in these electronic devices, the USB type connectors employed are quite small and commonly are termed as such or as "miniature" connectors.

As is well known, in a connector plug, which is used to connect to a connector socket mounted on a printed circuit board and the like, a shield case covers the outside of an inner insulated body, which supports a plurality of contact conductors (contacters). The exterior surface of the end part on the connection cord side of this shield case is covered with an external insulated mold.

In this kind of connector plug, each contact conductor is placed in a contact conductor housing hole, which is formed in the inner insulated body. The connection ends of these contact conductors are soldered to the core wires of a connection cord. If the alignment pitch of the contact conductor housing holes and the contact conductors is smaller in keeping with achieving miniaturization, undesirable contacts between of the connection ends of the contact conductors and the core wires can occur.

During the forming of the external insulated mold, a large resin pressure is imposed on the inner insulated body, and due to deformation of the inner insulated body, the likelihood of the aforementioned contacts problem is increased.

For this reason, with the connector plug of the prior art, contact between adjacent connection ends of the contact conductors or between core wires is prevented by completely separating from each other the contact conductor housing holes, formed in the inner insulated body.

However, with recourse to complete separation of the contact conductor housing holes, a certain amount of thickness for the partitioning wall between contact conductor housing holes is necessary. As a result, there is a limit to the amount that the alignment pitch for the contact conductor housing holes and the contact conductors can be reduced and optimum miniaturization made difficult.

OBJECT AND SUMMARY OF THE INVENTION

The object of the present invention is to provide a miniature connector with a construction that assures, even when the alignment pitch of the contact conductor housing holes and the contact conductors is made very small, contacts between the connection ends of the contact conductors and the core wires that are soldered to these are prevented.

In order to achieve this object, the present invention proposes a miniature connector, the miniature connector having an inner insulated body, which supports a plurality of contact conductors which contact conductors on a companion connector; the inner insulating body being surrounded on the outside by a shield case; and an outer surface of a connection cord side end of the shield case being covered by an external insulated mold, wherein: adjacent contact conductor housing holes, in which connection ends of the contact conductors are placed, have differing depths; a connecting part cover, which is formed in a unitary manner with the inner insulated body, prevents a connection cord core wire, which is soldered onto each of the connection ends, from slipping out of the corresponding contact conductor housing hole.

In the detailed description of the preferred embodiment of the present invention given later, the following features will be explained.

1) A construction, wherein by having alternately different depths for the contact conductor housing holes, the connection cord core wires, which are to be soldered onto the connection ends, are arranged in a zig-zag manner.

2) A construction, wherein wide grooves, which receive non-adjacent core wires of the connection cord, are formed on the surface of the connecting part cover.

3) A construction, wherein a connecting part cover is formed in a unitary manner with a main body part of the inner insulated body via a thin walled hinge.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
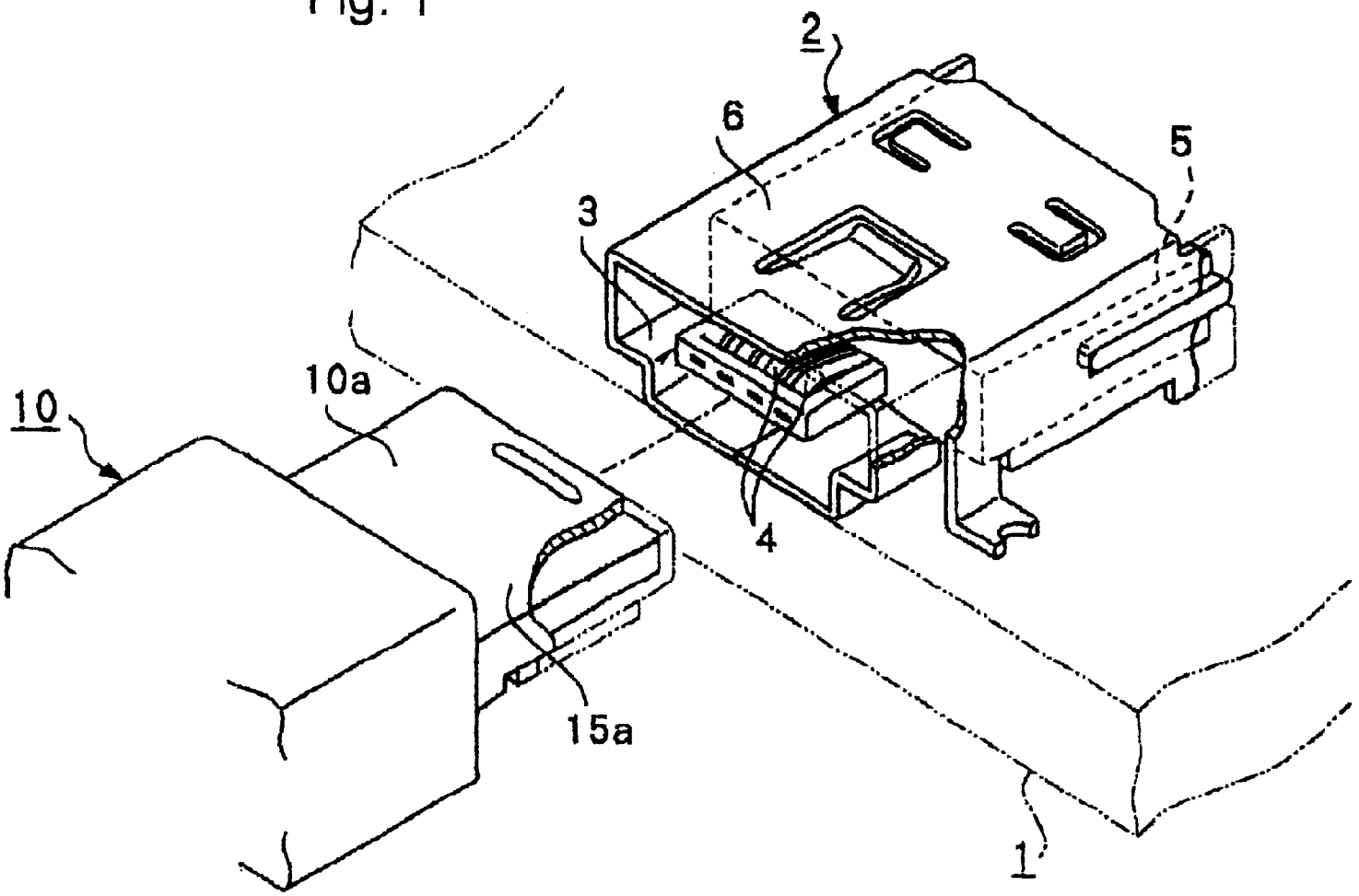
FIG. 1 is a perspective view of a miniature connector of the present invention with a section removed.
Figure 2:
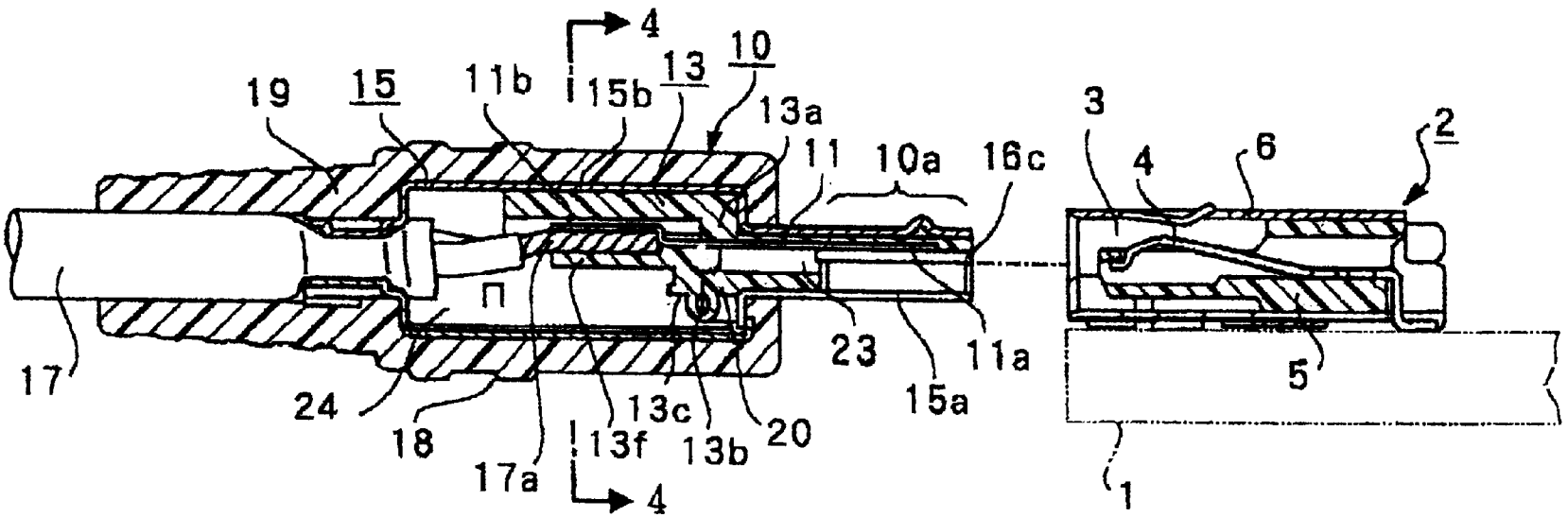
FIG. 2 is a longitudinal cross-section view of the miniature connector.

Referring to FIGS. 1 and 2, a plug part 10*a* of a connector plug 10 is inserted in a detachable manner into an insertion opening 3 of a connector socket 2, which is mounted on a printed circuit board 1.

Connector socket 2 includes an insulated mold 5, which supports a plurality of contacts 4 which are aligned in the cross direction. Insulated mold 5 is housed in a metal shield case 6 of rectangular tubular configuration. Insulated mold 5 is shielded from the effects of external electric fields and external magnetic fields by shield case 6.

Connector plug 10 has a plug part 10*a* and an inner insulated body 13, which supports a plurality of contacters 11 (contact conductors) which are aligned spaced parallel with each other and extending perpendicular to the viewing direction in FIG. 2. Inner insulated body 13 is surrounded by a shield case 15 of metal plate bent and formed into rectangular tubular configuration.

Inner insulated body 13, which is an injection molded component, includes a main body 13*a*, in which a plurality of contacter housing grooves or housing holes 16A, 16B (FIGS. 3 and 4), which are on a cord connecting part side of the connector plug and extend in the longitudinal direction of inner insulated body 13. Contacters 11 are each positioned inside contacter housing grooves 16A, 16B, contact passage hole 23, and plug part side contact housing groove 16C. However, when a contacter 11 is inserted into contacter housing grooves 16A, 16B, a contact end part 11*a* and a connection end 11*b* are exposed in housing grooves 16A, 16B and in contact housing groove 16C in order to have elastic contact with contact 4 and to have been soldered onto core wire 17*a* of connection cord 17.

Shield case 15 has a plug part shield 15*a*, of the same cross-sectional shape as insertion opening 3 of connector socket 2. A cord connecting part 15*b*, which has an enlarged cross-sectional shape, formed continuous with plug part shield 15*a*. After housing inner insulated body 13 and connection cord 17, along with the surface of cord connecting part 15*b*, into which an end of connection cord 17 are introduced, is closed by a shield cover 18.

Furthermore, in the manufacture process for connector plug 10, after assembling shield case 15, shield cover 18, inner insulated body 13, and connection cord 17, these are placed together in an injection molding die, and external insulated mold 19 is molded onto the outer surface of everything except plug part shield 15*a*.

Figure 3:
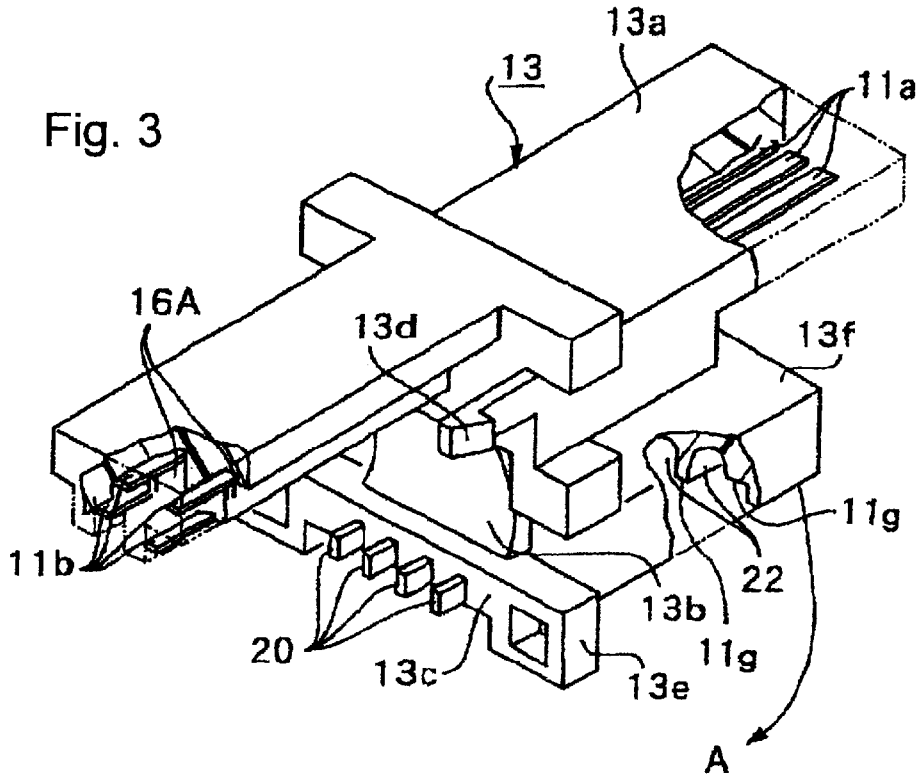
FIG. 3 is an enlarged perspective view partly broken away of the inner insulated body of the same miniature connector with a section removed.
Figure 4:
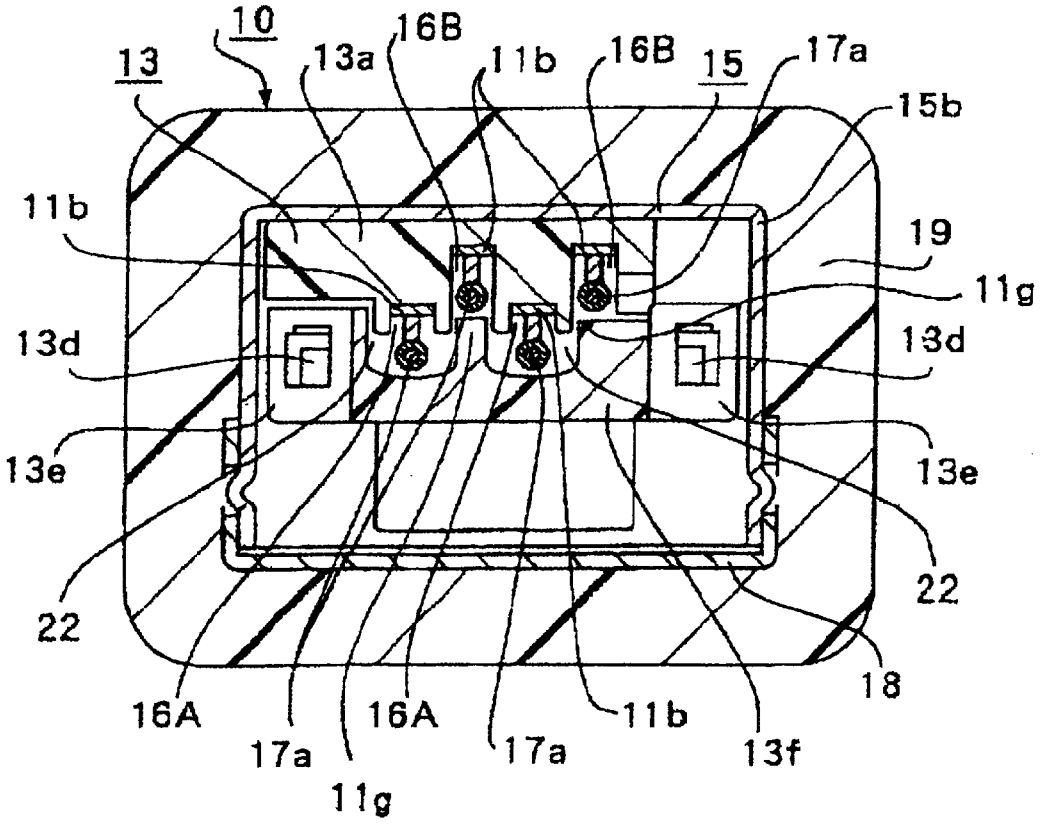
FIG. 4 is an enlarged cross-section view of FIG. 2 taken along line 4—4.

Referring to FIGS. 3 and 4, the details of inner insulated body 13, which is injection molded, are shown. Contacter housing grooves 16A, 16B are formed in main body part 13*a* of inner insulated body 13. Referring to FIG. 4, adjacent contacter housing grooves 16A, 16B in the alignment direction have alternately differing depths. As a result, when connection ends 11*b* of contacters 11 are installed into contacter housing grooves 16A, 16B, connection ends 11*b* are arranged in a zigzag manner.

Therefore, in contacter housing grooves 16A, 16B, core wires 17*a*, which are soldered onto connection ends 11*b* of contacters 11, are also arranged in a zigzag manner.

Referring to FIGS. 2 and 3, a flap member 13*c*, which is bent via a thin-walled hinge 13*b* in the direction A, is formed in unitary manner on the lower part of main body part 13*a* of inner insulated body 13. The flap member 13*c* carries a plurality of small plug protrusions 20, which by swinging the flap member from the FIG. 3 to FIG. 2 position thereof, can become inserted into contacter passage holes 23. The protrusions are formed in unitary manner with the surface of flap member 13*c* as seen from FIG. By inserting plug protrusions 20 into the corresponding contacter passage or housing holes 23, the holes of contacter passage holes 23 can be closed off by the blocking presence therein of the protrusions.

A pair of locking tabs 13*d*, which are positioned on both ends of thin-walled hinge 13*b*, are formed unitary with the on main body part 13*a*. Corresponding to locking tabs 13*d*, strikers 13*e*, in the form of rectangular frames, are formed in a unitary manner on the right and left sides of flap 13*c*.

Flap 13*c* is bent 180 degrees from the FIG. 3 position and plug protrusions 20 become aligned with and inserted into the corresponding contacter passage holes 23, flap member 13*c* being pushed strongly against the middle surface of main body part 13*a*. With this action, locking tabs 13*d* also become engaged inside strikers 13*e*, and main body part 13*a* and flap 13*c* become securely fastened to each other. Contacter passage holes 23 are completely closed off by plug protrusions 20. The plug protrusions 20 are prevented from inadvertently slipping out of contacter passage holes 23, and block them to prevent resin from the external insulated mold 19 forming operation from entering contacter passage holes 23.

The flap member structure includes a connecting part cover 13*f*. With flap member 13*c* fastened to the main body part 13*a* by locking tabs 13*d*, the main expanse of connecting part cover 13*f* acts as a cover at the connection part side of main body part 13*a* to cover the part where the contacters are soldered to associated core wires 17A. Wide grooves 22 are formed on the surface of connecting part cover 13*f*. Wide grooves 22 are positioned opposite contacter housing groove 16A, which is the shallower of contacter housing grooves 16A, 16B, and span between adjacent contacter housing grooves 16A, 16B. Core wires 17*a* that are soldered onto connection ends 11*b* in the shallow contacter housing groove 16A are placed in wide grooves 22.

Furthermore, core wires 17*a* that are soldered onto connection ends 11*b* of deep contacter housing groove 16B are prevented from popping out of their corresponding contacter housing grooves 16B by restraint pieces 11*g* on connecting part cover 13*f*. Adjacent core wires 17*a*, which are soldered onto connection ends 11*b* of contacters 11, are completely separated vertically. Inadvertent contacts between core wires 17*a* are prevented in advance.

In making connector plug 10, after contacters 11 are inserted into contacter housing grooves 16A, 16B of inner insulated body 13 and each connection end 11*b* is soldered onto core wire 17*a* of connection cord 17, inner insulated body 13 is placed inside shield case 15. The open part of shield case 15 is covered with shield cover 18. Connector plug 10 is completed by forming an external insulated mold 19 surrounding shield case 15 and shield cover 18. During the mold formation, resin enters by high pressure into a connection area 24 inside the shield case cover.

In the process for attaching contacters 11 into inner insulated body 13, each contacter 11 is passed through contact passage hole 23. After inserting contacters 11 into contacter housing grooves 16A, 16B, 16C, flap member 13*c* is swung from thin-walled hinge 13*b* 180 degrees towards main body part 13*a* of inner insulated body 13, and plug protrusions 20 are inserted into corresponding contact passage holes 23 blocking them. By pushing flap 13*c* strongly against main body 13*a*, locking tabs 13*d* fall into strikers 13*e*. Spaces in contact passage holes 23, where there is the risk of having resin from external insulated mold 19 enter, are eliminated.

In addition, when locking tabs 13*d* are fastened to flap member 13*c*, the lower surface of main body 13*a* is covered by connecting part cover 13*f*. Core wires 17*a* of connection cord 17, which are soldered onto connection end part 11*b* in each of contacter housing grooves 16A, 16B, are covered completely by connecting part cover 13*f*. In addition, adjacent connection end parts 11*b* are positioned in a separated manner in deep contacter housing grooves 16B and in wide grooves 22, which are formed on connecting part cover 13*f*. As a result, even if the alignment pitch of contacters 11 and contacter housing grooves 16A, 16B is made small, there is no short circuiting of adjacent connection ends 11*b* and core wires 17*a*.

Wide grooves 22 are formed on connecting part cover 13*f* and span between contacter housing grooves 16A, 16B which are adjacent in the cross-direction. Wide grooves 22 also house core wires 17*a* that are soldered to contacters 11 of shallow contacter groove 16A. In addition, core wires 17*a* of connection cord 17 which are positioned inside deep contacter housing grooves 16B are prevented from popping out of each deep contacter housing groove 16B by restraint pieces 11*g* of connecting part cover 13*f*. As a result, there is no short-circuiting.

As is clear from the above description, by the present invention, adjacent contact conductor housing holes, which house the connection ends of contact conductors, have differing depths. The connection cord core wires, which are to be soldered onto the connection ends, are placed at the corresponding contact housing holes. As a result, the connection ends and the core wires are offset towards the depths of the contact housing holes. Because these are covered by a connecting part cover, formed in unitary manner with the inner insulated body, contacts during the formation of the external insulated mold are reliably prevented.

Because the connecting part cover is formed in a unitary manner with the main body when forming the inner insulated body, manufacturing costs do not rise, and assembly can be conducted without needing special tools. If wide grooves are formed on the surface of the connecting part cover, adjacent connection ends and core wires can be separated even more, and there is even more protection against accidental contacts.

Furthermore, by having a locking means between the main body of the inner insulated body and the connecting part cover, the connecting part cover can easily protect the connection ends and the core wires.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a connector plug, an inner insulating body, said insulating body including a main body part having a plurality of passages therein, said passages being open at an underside of said insulating body, a corresponding plurality of contact conductors disposed in said passages, each contact conductor having a contact end and an opposite connecting end connected to an associated core wire, the contact end of each contact conductor being engagable with a corresponding conductor carried in a companion connector socket when the connector plug is inserted in said connector socket, the passages wherein the connecting ends of said contact conductors are disposed having differing depths, said inner insulating body being surrounded on an outside thereof by a shield case, an external insulated resin mold covering an outer surface of a connection side end of said shield case, said insulating body carrying a flap member integrally hinged with said main body part at an underside of said main body part, said flap member including a cover part, said flap member being swingable to a position wherein said cover part covers said passages at least where the conductor connector ends are connected to associated core wires, thereby to prevent said core wires from popping out said passages.

2. The connector plug of claim 1 in which alternate ones of said passages have different depths so that the corresponding ones of core wires associated with said passages define a zig-zag core wire profile.

3. The connector plug of claim 2 in which a surface of said cover part facing the underside of said main body part includes grooves receiving nonadjacent adjacent ones of said core wires.

* * * * *

UNITED STATES PATENT AND TRADEMARK OFFICE

CERTIFICATE OF CORRECTION

PATENT NO. : 6,358,088 B1 
DATED : March 19, 2002
INVENTOR(S) : Atsushi Nishio and Katsuhio Hori It is certified that error appears in the above-identified patent and that said Letters Patent is hereby corrected as shown below:

Title page,
Item [75], Inventors: "Atsushi Nishio, Ibaraki; Katsushio Hori, Mito; Kazuhiro Okazaki, Hitachinaka; Fumihiro Hosoya, Ibaraki, all of (JP)", should be corrected to read -- Atsushi Nishio, Ibaraki; Katsuhiro Hori, Mito, both of (JP) --

Signed and Sealed this

Third Day of September, 2002

*Attest:*

*Attesting Officer*

JAMES E. ROGAN
*Director of the United States Patent and Trademark Office*